US005862949A

United States Patent [19]

Markey et al.

[11] Patent Number: 5,862,949

[45] Date of Patent: Jan. 26, 1999

[54] DUAL CONTAINER AND INDIVIDUAL CHAMBER THEREFOR

[75] Inventors: Kevin Joseph Markey; Mark Douglas Gerhart, both of Westminster; Gregory Alan Lathrop, Manchester, all of Md.; Frank Gonda, Fairfield, Conn.; Karl Dallas Kirk, III, New York, N.Y.; Bartoez Matthew Marzynski, New York, N.Y.; James Troy Collins, III, New York, N.Y.

[73] Assignee: Lever Brothers Company, Division of Conopco, Inc., New York, N.Y.

[21] Appl. No.: 722,755

[22] Filed: Sep. 27, 1996

[51] Int. Cl.[6] ..... B67D 5/60

[52] U.S. Cl. ..... 222/143; 222/214

[58] Field of Search ..... 222/214, 129, 222/183, 143, 185.1

[56] References Cited

U.S. PATENT DOCUMENTS

| | | | |
|---|---|---|---|
| D. 245,225 | 8/1977 | Lyons . | |
| D. 311,133 | 10/1990 | Wiseman et al. . | |
| D. 353,326 | 12/1994 | Abfier et al. . | |
| 3,225,951 | 12/1965 | Poston et al. . | |
| 3,933,268 | 1/1976 | Buske . | |
| 4,072,249 | 2/1978 | Ekenstam et al. | 222/143 X |
| 4,165,812 | 8/1979 | Jennison . | |
| 4,196,808 | 4/1980 | Pardo . | |
| 4,573,595 | 3/1986 | Mednis . | |
| 4,640,423 | 2/1987 | Mednis . | |
| 4,773,562 | 9/1988 | Gueret . | |
| 4,826,048 | 5/1989 | Skorka et al. . | |
| 5,105,989 | 4/1992 | Gutkowski . | |
| 5,158,191 | 10/1992 | Douglas et al. . | |
| 5,158,209 | 10/1992 | Reil et al. . | |
| 5,261,571 | 11/1993 | Goncalves | 222/214 |
| 5,289,950 | 3/1994 | Gentile . | |
| 5,316,159 | 5/1994 | Douglas et al. . | |
| 5,356,040 | 10/1994 | Reggiani . | |
| 5,386,928 | 2/1995 | Blette . | |
| 5,392,947 | 2/1995 | Gentile . | |

*Primary Examiner*—Gregory L. Huson
*Attorney, Agent, or Firm*—Gerard J. McGowan, Jr.

[57] ABSTRACT

A dual bottle formed by two separable interlocked compartments held together by a girdle The girdle includes pressure plates and straps holding it in place. The front walls of the compartments are recessed to accommodate the girdle. The chambers preferably each contain different ingredients and have product exit apertures. The product emerges from a common closure. Preferably the chambers and girdles are identical, which simplifies manufacture.

20 Claims, 6 Drawing Sheets

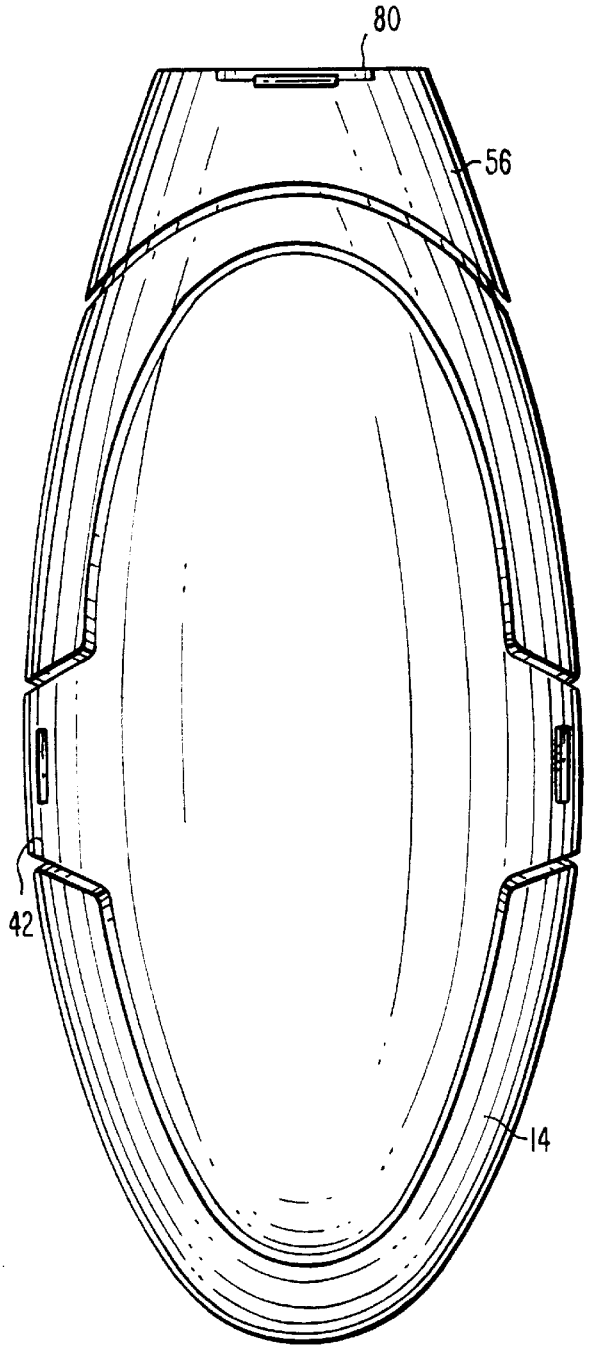
FIG. 5
FIG. 6
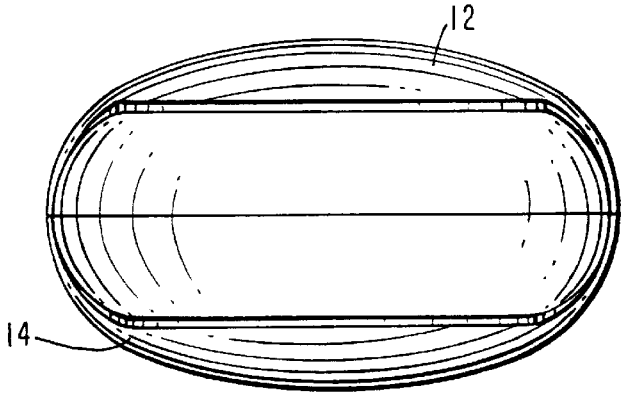

DUAL CONTAINER AND INDIVIDUAL CHAMBER THEREFOR

BACKGROUND OF THE INVENTION

In the dispensing of modern consumer products, it is sometimes desirable to keep one or more of the components separate until just before dispensing them in the final product. For example, it may be necessary to keep bleach and enzyme ingredients separate prior to dispensing the product to prevent undesirable, premature reaction of the components. Other examples where it may be desirable to keep ingredients separate in consumer products include surfactant and conditioner ingredients in shampoos and surfactant and moisturizer ingredients in shower gels.

While dual containers are desirable, it is also important that their fabrication be as simple and economical as possible. This objective is furthered if, for example, the dual compartments are identical.

Numerous dual chambered or multiple bottle packages are known in the art.

Stokes et al. U.S. Pat. No. 5,137,178 discloses a dual container for delivering two composition streams held in separate compartments. Each of the compartments is flexible walled and received in a relatively rigid receptacle. A button is provided which, when squeezed, compresses the respective compartments forcing the compositions to exit.

Gentile, U.S. Pat. No. 5,289,950 discloses a package for dispensing at least two liquid components simultaneously. The package comprises a container having at least two discrete compartments, each with an upper outlet end. A closure system for the container includes a crown portion having a peripheral skirt portion depending downwardly. At least two pouring spouts extend upwardly from the crown. Each pouring spout is provided with a through opening which extends from the upper end of the spout into a compartment. Separate storage compartments 8, 10 are provided. The two compartment container can either be formed of two entirely separate compartments which are held together by a closure system or can be formed by a dividing wall in the container. The closure system engages the outer surface of the container in a fluid tight manner. A conventional groove and bead snap fit engagement, which can be substituted with known equivalent engagements or seals, may be used.

Blette, U.S. Pat. No. 5,386,928 discloses a system for dispensing materials made of two components including a side by side pair of collapsible tubes that fit within a barrel of a pressurized air applicator. When air is admitted into the barrel, the tubes simultaneously collapse to direct components through outlet ports and into a static mixer where the components are mixed to a homogeneous mass. Each tube includes a relatively rigid front and rear end piece and the end pieces are coupled together by pin elements.

Gentile, U.S. Pat. No. 5,392,947 discloses a dental mouthwash product which includes a dispensing container having at least two discrete compartments. A closure mechanism is sealingly attached to an upper end of the dispensing container. The two compartments can either be formed of two entirely separate compartments which are held together by the closure or can be formed by a dividing wall in the container.

Pardo, U.S. Pat. No. 4,196,808 discloses sequential closure interlock devices for container packages having multiple product compartments provided with parallel neck finishes lying generally in a single plane. The unitized package may further comprise means such as a shrink wrap joining the containers into a unified package. More than two compartments and/or bottles or containers may be utilized and other means than the shrink wrap bands may be utilized to join the bottle or containers into the unified package. For example, label panels spanning the joint between the bottles or containers and bonded to each of the bottles or containers may be used, as may direct bonding of the bottles or containers to each other. Other types of bands or outer packaging or wraps may also be similarly utilized.

Buske, U.S. Pat. No. 3,933,268 discloses a container for packaging liquids having the form of preferably a right prism with two polygonal bases and being adapted to be placed with at least one of its basal and lateral faces against corresponding faces of similarly formed containers to form a group of containers. At least one of the basal and lateral faces is provides with means for engaging a corresponding face of a similar container when placed against the corresponding face to counteract slipping between the engaging faces.

Poston et al., U.S. Pat. No. 3,225,951 comprises a washer reservoir construction which includes integral formations for supporting a bottle of concentrated washer solvent, thus eliminating the need for a separate fastening clip. The washer reservoirs and solvent containers may have complimentary formations of the tongue and groove type.

Abfier et al., U.S. Pat. No. DES 353,326 discloses the design for what appears to be a dual container.

Jennison, U.S. Pat. No. 4,165,812 discloses a multi-container package wherein the containers are detachably connected by projections and recesses.

Mednis, U.S. Pat. No. 4,573,595 discloses a multi purpose container unit whose hollow body neck and shoulder sections are proportioned and constructed in a manner that allows interfacing and mating with an identical or mirror image unit of like size, volume or exterior proportions.

Mednis, U.S. Pat. No. 4,640,423 discloses containers mated together to form a polyhedron.

Douglas et al., U.S. Pat. No. 5,158,191 discloses a dual container having two bottles which are releasably interlocked in side-by-side relation by a mortise and tenon. A single cap covers both bottles, but the cap has a separate outlet for each bottle, which may be opened independently of each other.

Douglas et al., U.S. Pat. No. 5,316,159 discloses a dual bottle container wherein two bottles are releasably interlocked together in side-by-side relation by a plateau on one of the bottles which engages a depression on the other bottle.

Reil et al., U.S. Pat. No. 5,158,209 discloses a package for flowable media comprised of two tube-shaped parts each forming an entire side wall, two oppositely disposed and adjacent half side wall parts, a half bottom part and a half upper wall part with a half pourer device. These are in each case sealed and connected to each other individually by a synthetic plastic film.

Gueret U.S. Pat. No. 4,773,562 discloses a dispenser hand fitted on two separate reservoirs.

Skorka et al. U.S. Pat. No. 4,826,048 discloses a dispenser having two reservoirs and discharge pumps, both pumps being operable by means of a common handle. The components are said to be brought together at the last possible moment.

There remains a need for an improved dual container for dispensing separately stored components together.

SUMMARY OF THE INVENTION

The present invention is directed to a dual chamber dispensing package which is suitable for keeping ingredients separate prior to dispensing, but permitting the ingredients to be dispensed together, preferably in relatively equal amounts.

Each chamber of the dispensing package is defined by a compartment which includes a first, front wall and a second, rear wall. The front wall includes a recessed area which accommodates a girdle having a pressure plate or a portion of said girdle. In a preferred embodiment, one aspect of the recess is centrally disposed since each pressure plate is centrally disposed. Another aspect of the recess is narrower and accommodates lateral sections of the girdle which link the two pressure plates together. Preferably each compartment includes a bottom which includes the product exit opening and a top on an opposite end. A first axis may be considered to extend from the top to the bottom and at least part of the recess preferably extends throughout the first wall of the compartment along a plane perpendicular to the axis.

The girdle is preferably comprised of two identical halves, each half comprising a medial pressure plate and lateral straps at either end thereof to connect with the other half of the girdle. The straps may be linked by a male/female bayonet arrangement or similar locking means.

The front surfaces of the two chambers are preferably softer whereas the pressure plates of the girdle are rigid. The softness of the chamber first walls results from selection of a soft material or from employing a thinner wall or both. The compartment first walls should be soft enough to flex easily when pressure is applied by one hand. The straps of the girdle are less rigid than the pressure plates so that the girdle can flex at the straps. The pressure plates serve to dissipate the force applied to the two chambers, minimizing the pressure inequality which has been associated with previous hand-held dual dispensers. Preferably the loading or pressure plates are attached to the front surfaces of the soft-walled compartments so that when the plates rebound after product is dispensed, the plates help the bottles to vent. As such, the pressure plates act as leaf springs.

The dispenser preferably uses a common closure for both of the product exit openings. The closure may include an aperture for each of the openings and a flip top cap.

An advantage of the present dispenser is that the number of components are minimized. Moreover, since two identical chambers and two identical halves of the girdle are used, manufacturing resources are conserved.

For a more complete understanding of the above and other features and advantages of the invention, reference should be made to the following detailed description of the preferred embodiments and to the accompanying drawings.

BRIEF DESCRIPTION OF THE DRAWINGS

FIG. 5 is a rear elevational view of the dispenser according to the invention.

FIG. 6 is a bottom plan view of a dispenser according to the invention.

DETAILED DESCRIPTION OF THE INVENTION

Figure 1:
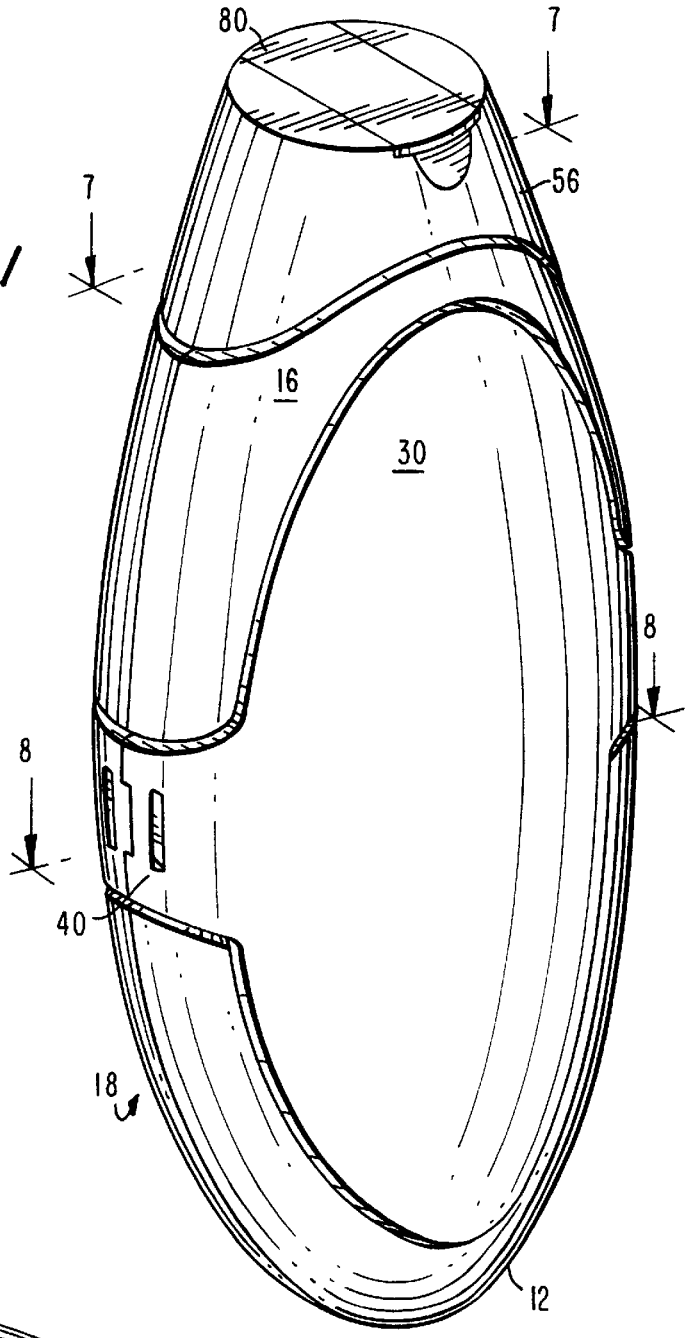
FIG. 1 is a perspective view of the dispenser of the invention.
Figure 2:
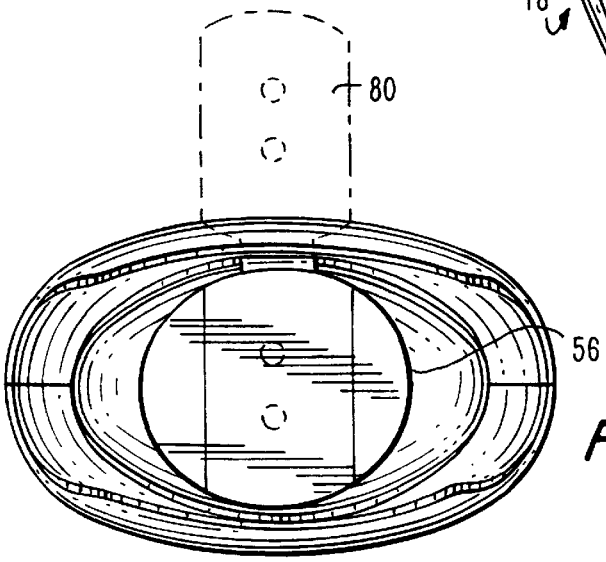
FIG. 2 is a top plan view of a dispenser according to the invention.

Dual chambered dispenser 10 comprises first compartment 12 and second compartment 14. Chamber 12 includes a front or first wall 16 and a second or rear wall 15. Likewise, chamber 14 includes a first wall 18 and a rear or second wall 20. Rear walls 15, 20 are flat except for optional projections and apertures as will now be described. Projection 22 extends out of the surface of wall 20. Aperture 24 extends into the surface of wall 20. Projection 22 mates with a corresponding aperture on second wall 15 of compartment 12 and aperture 24 receives a corresponding projection on wall 15 of compartment 12 when the two compartments are placed with their second surfaces in contact. The apertures and projections help to align the compartments during assembly and keep them together. The second surfaces of the compartments may also be adhered to each other with adhesive or other sealing means, preferably at the centermost point of each second wall of the compartment. Further projections and apertures may be present on the second surfaces of the compartments, e.g. a further aperture at the same level of projection 22 and a further projection on the same level as aperture 24 for compartment 14, together with mating projections and apertures on compartment 12.

First surface 16 of compartment 12 includes recessed area 26. The recess extends along much of the height of the compartment in central areas and for a shorter distance on the sides. The recess is shaped to accommodate the full, centrally disposed first and second pressure plates, 30, 32 of girdle 34. The recesses function to position the girdle with respect to the compartments. On the sides, the recess of the first walls are shaped to accommodate straps 36, 38, 40, 42 of the girdle. Straps 36, 38 and 40, 42 interlock by means of a bayonet arrangement, 46, having male and female members, or other locking means, preferably mechanical.

Compartments 12, 14 include product exit openings 50, 52. Package 10 includes common closure 56 which comprises depending peripheral wall 58, inner depending wall 60, which surrounds openings 50, 52, and half moon walls 62, 64, which mate with half moon shaped finishes 70, 72 within which are disposed about openings 50, 52. Preferably half moon walls 62, 64 are friction fit within half moon-shaped finishes 70, 72. The tops of finishes 70, 72 may be beveled to accommodate insertion of walls 62, 64 within finishes 70, 72. Although walls 62, 64 and finishes 70, 72 are illustrated with a half moon shape, it will be appreciated that other shapes may be used, especially circular or other predominantly rounded shapes, which facilitate molding. Closure 56 is retained on finishes 70, 72 by rib 106 which is locked below broken ribs 108.

Figure 3:
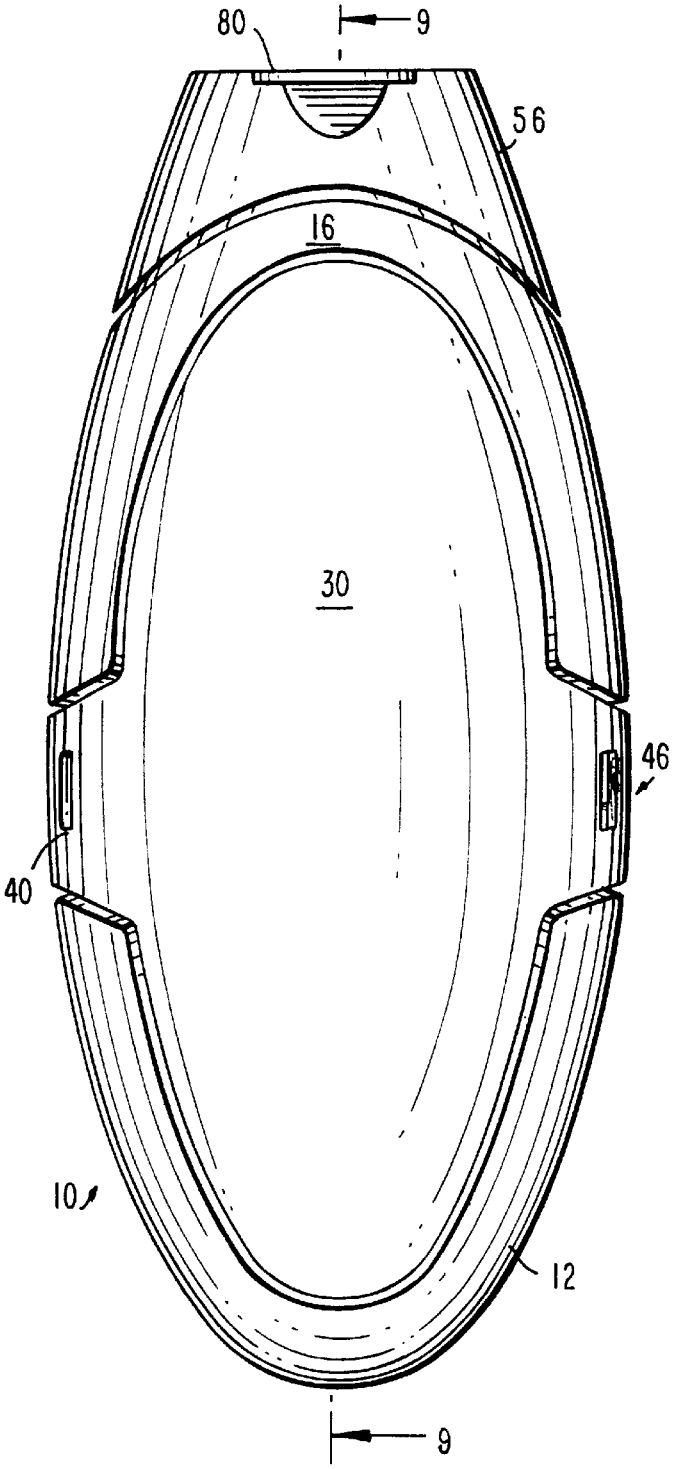
FIG. 3 is a front elevational view of the dispenser of the invention.
Figure 4:
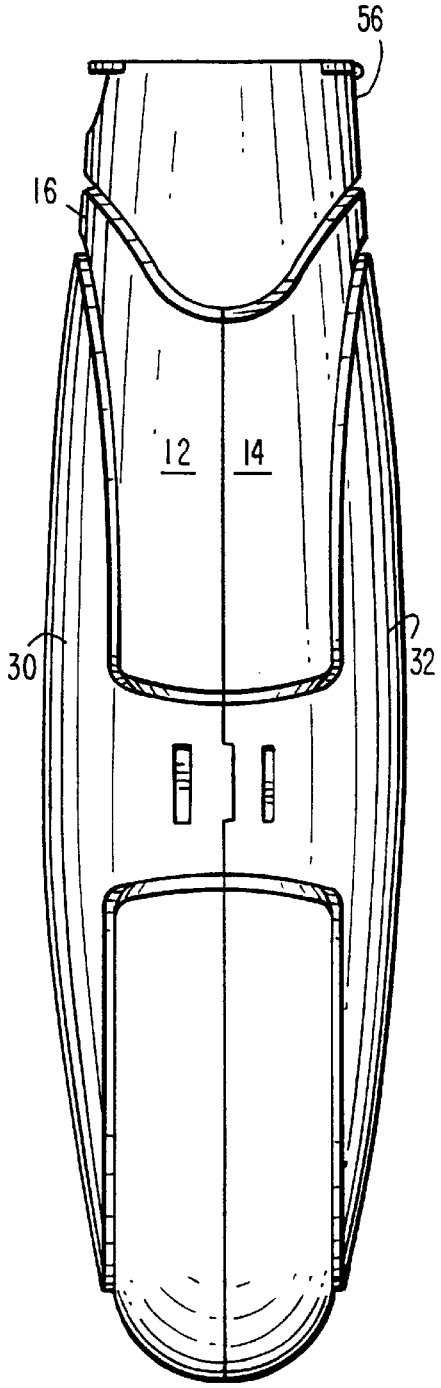
FIG. 4 is a side elevational view of the dispenser of the invention.
Figure 7:
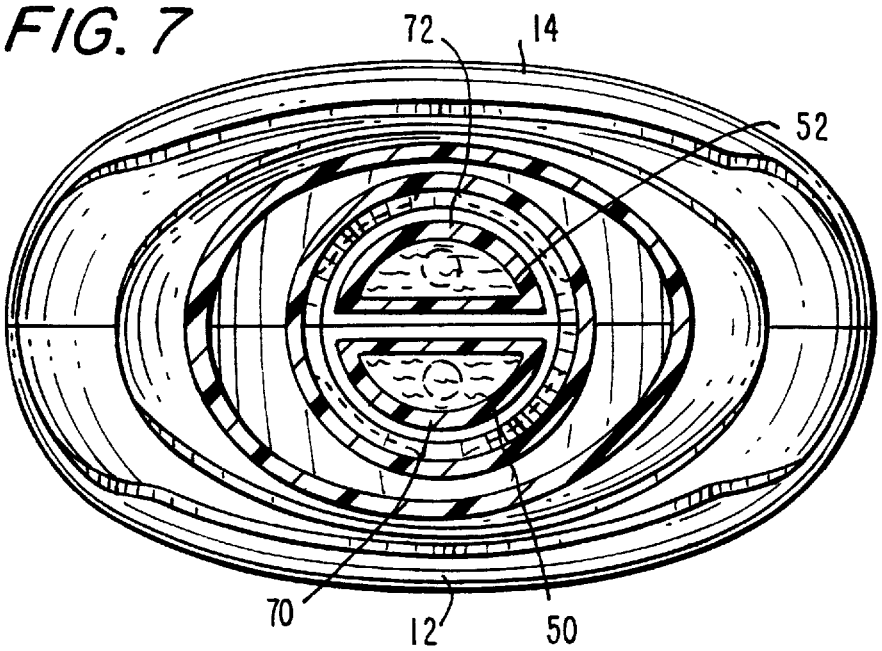
FIG. 7 is a cross section along the lines 7—7 of FIG. 1.
Figure 8:
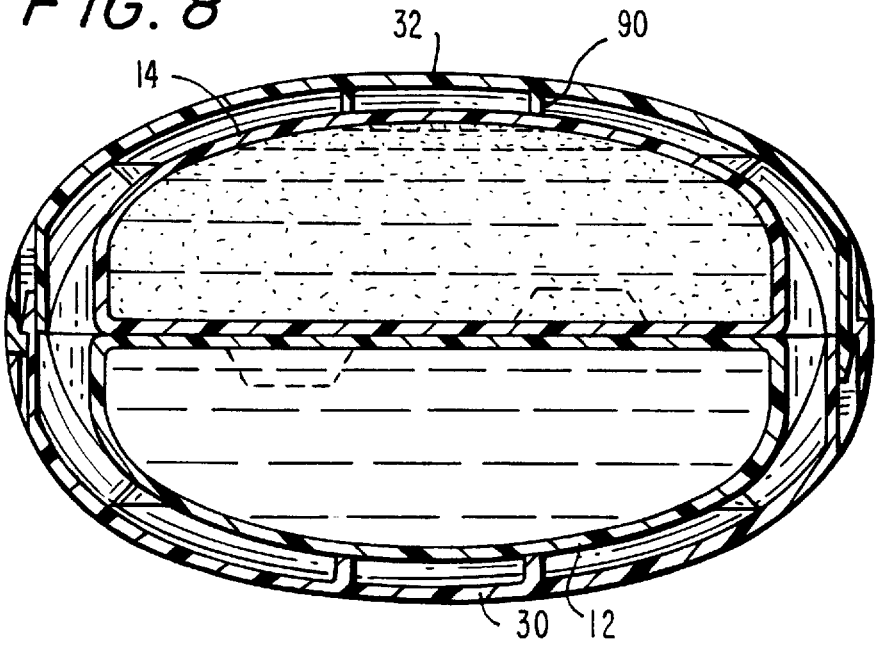
FIG. 8 is a cross section along the lines 8—8 of FIG. 1.
Figure 9:
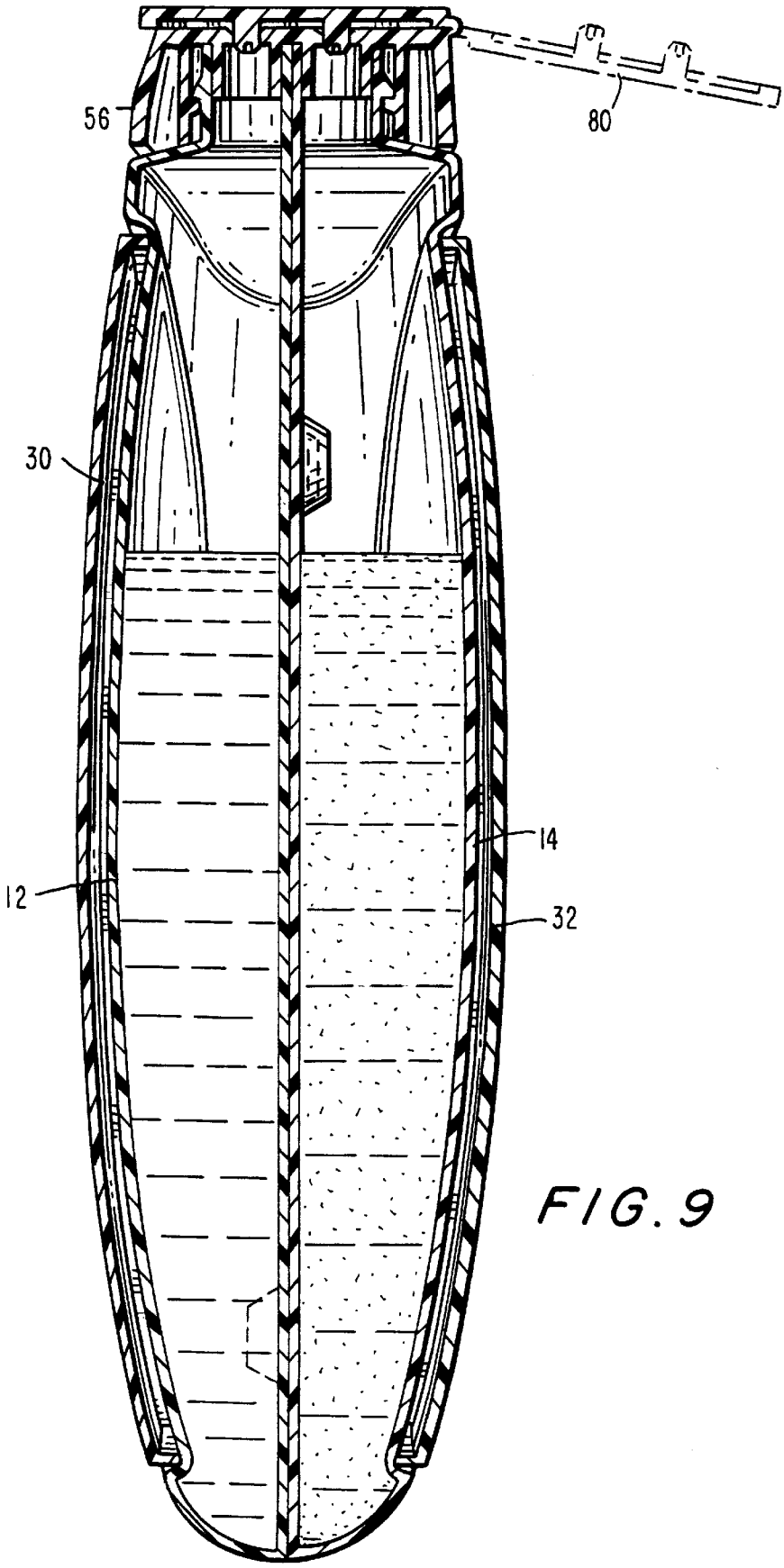
FIG. 9 is a cross section along the lines 9—9 of FIG. 3.

Centrally positioned within each of the half moon shaped depending walls 62, 64 are product exit apertures 78. Apertures 78 are covered by cap 80 when it is in the closed position as shown in FIG. 3 but are in communication with the outside of the container when cap 80 is in the open position as seen in FIG. 5.

Compartments 14, 16 are snap fit into closure 56, which holds the tops of the compartments together.

The interior walls of the pressure plates 30, 32 of girdle 34 are provided with ribs 90 to assist in transmission of pressure applied to the front wall of the plates.

Each of compartments 12, 14 may be identical, as shown. They may be assembled by placing their generally flat walls back to back so that any projections on one wall are received within apertures on the other, thus helping to secure the compartments together. In addition, it is preferred that the chambers be affixed together as by gluing, particularly near the center of the second walls.

Once the compartments have been glued together, the girdle may be put in place. The girdle fits within the recesses of the first walls of the compartments and the straps of the girdle interlock so that the girdle extends 360° around the compartment. In addition, it is preferred that the inside surfaces of the pressure panels, eg. the ribs, of the girdles be affixed to the first surfaces of the compartments, particularly toward the center of the surfaces. This may be accomplished by gluing or otherwise.

Product may be filled into the chambers through openings 50, 52, before or after the compartments are placed together and before or after the girdle is secured around the two compartments. After the chambers have been filled with product, and once the dispenser has been otherwise assembled, closure 56 is snapped onto finishes 70, 72.

In order to use the product, the cap 80 is snapped open and the product is held, preferably in one hand, such that pressure is placed on pressure plates 30 and 32. Since pressure plates 30 and 32 are relatively rigid and first walls 16 and 18 of compartments 12 and 14 are relatively soft, the pressure is readily transmitted evenly to the first walls of the chamber whereby product is dispensed from each chamber at approximately the same rate. The walls of the chambers, particularly those of the first surfaces are preferably made of a relatively flexible plastic such as polyethylene, whether high density or low density. The girdle, particularly the pressure plates, is made of a relatively rigid plastic such as polypropylene.

It will be apparent from FIG. 5 that the girdle does not cover or encompass the product openings; otherwise the product openings would be blocked during use.

Preferably, straps 40, 46, 42 and 38 of the girdle are disposed in the middle third of the height of the dispenser, as ascertained from top to bottom of the overall dispenser.

An advantage of the present dispenser is that fluids can exit the dispenser roughly at the same rate, particularly if they have similar or substantially the same rheologies. Preferably given identical pressures applied to each plate of the girdle, fluid egress from the first chamber is at least 80% by volume, preferably at least 90% by volume of the fluid egress in the second chamber, more preferably at least 95% by volume. It is even more preferable that the above volumes are achieved within the same time period.

One way in which the first surfaces of the first and second compartments can be kept soft enough for their present functions is that they are relatively thin. The thickness may range from about, say, 1 to 30 thousandths of an inch. The thickness of the first and second surfaces of the first and second compartments will generally be about the same.

Figure 10:
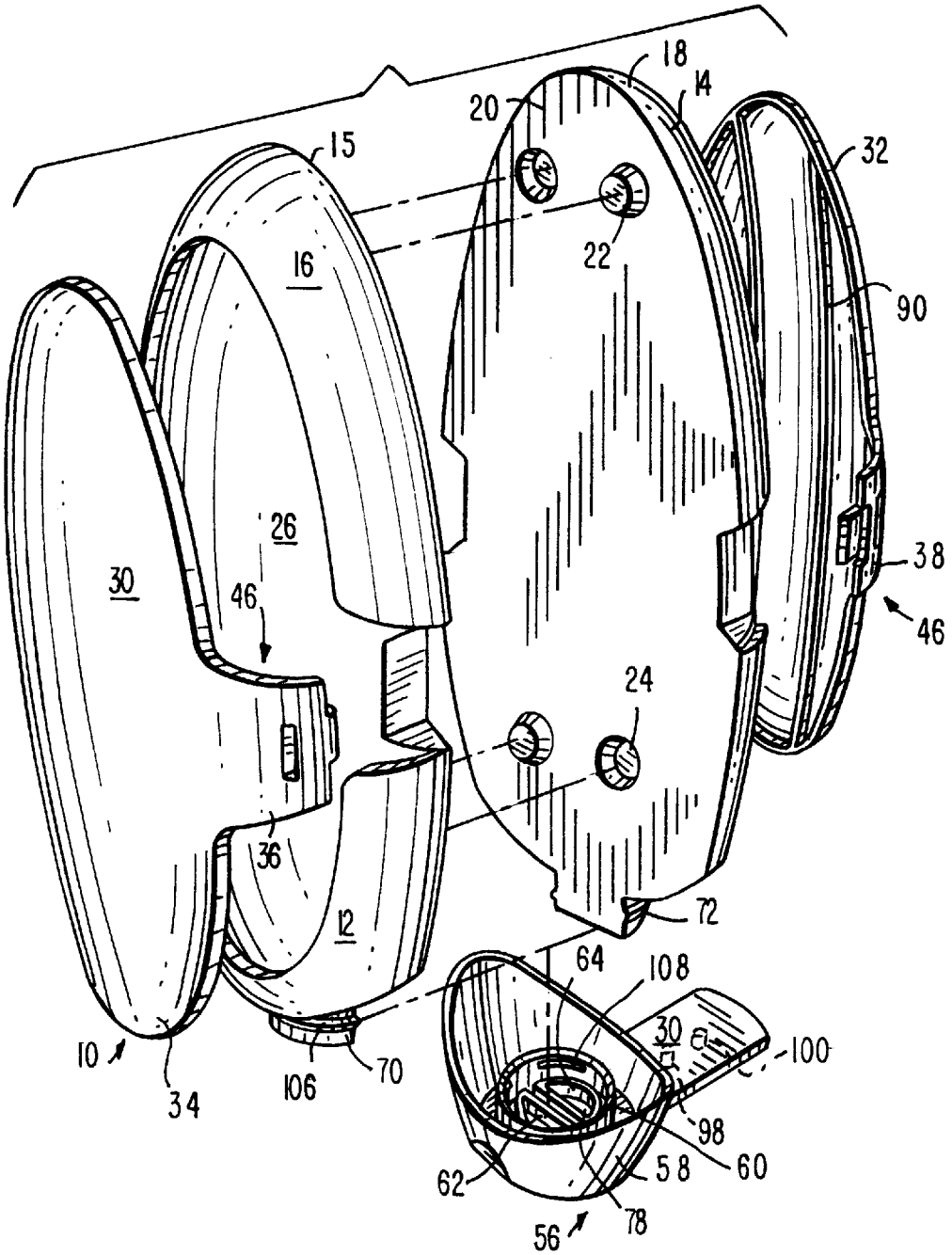
FIG. 10 is an exploded perspective view of a dispenser according to the invention.

Although closure 56 is illustrated as having two separate apertures for product egress, if desired the product streams may be combined into a single stream in closure 56 or indeed finishes 70 and 72 may be merged to create a single product exit opening. If desired, plugs 98, 100 (shown in phantom in FIG. 10) may be provided in cap 80 to plug openings 78.

Although the present preferred embodiments comprise compartments wherein the entire girdle fits within the recesses, this is not absolutely required. Other arrangements may be acceptable so long as the girdle is maintained in position over the compartments with each pressure plate covering a portion of a soft wall of the compartment. For instance, the pressure plate could cover a raised portion of the compartment wall and include a depending peripheral ridge which extends into a recess, i.e. a non-raised portion of the compartment.

The pressure plates preferably cover a large percentage of the areas of the first and second compartment first surfaces. Consequently, it is preferred that at least 60% of the area of the first surface of the wall of the first and second compartment is recessed. It is not necessary that the pressure plates contact a large portion of the compartment first surfaces. For instance, ribs 90 may do the contacting. Ribs 90 are preferably present on the outside surface of each pressure plate to add rigidity.

It will be appreciated that the dispenser of the invention provides a desirable way for dispensing two or more components which must be kept separate until just before they are dispensed. Examples of suitable ingredients for the respective chambers are surfactant and moisturizer ingredients in shower gels, surfactant and conditioner ingredients in shampoos and bleach and enzyme ingredients in household products.

It will be appreciated that the simplicity of the dispenser is a substantial advantage. In its preferred embodiment, in addition to the identical compartments only two identical girdle halves and a single common closure need be employed.

It should be understood, of course, that specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A dual chambered dispenser having a dispensing opening at one end comprising:

a) a first compartment having a first surface and a second surface on an opposite side thereof;

b) a second compartment having a first surface and a second surface on an opposite side thereof;

c) said second surfaces of said first and second compartments facing each other and at least partially contacting each other;

d) each of said compartments including a product opening, e) a locking girdle extending 360° around said first and second compartments and having a first pressure plate at least partially contacting said first compartment first surface and having a second pressure plate at least partially contacting said second compartment first surface, said girdle not encompassing said compartments product openings.

2. The dispenser according to claim 1 wherein said first surfaces of said first and second compartments are soft walled.

3. The dispenser according to claim 1 wherein said first and second pressure plates are rigid.

4. The dispenser according to claim 1 wherein said dispenser includes a bottom and a top at opposite ends, a first axis extending from said top to said bottom, at least part of said girdle extending 360° around said first and second chambers in a plane perpendicular to said axis.

5. The dispenser according to claim 4 wherein said plane intersects said axis within the middle third of said axis.

6. The dispenser according to claim 1 wherein said first and second compartments are identical.

7. The dispenser according to claim 1 combined with fluids in the chamber of each said compartments wherein pressure applied equally to said compartments results in fluid egress in said first chamber which is at least 65% by volume of the fluid egress in said second chamber.

8. The dispenser according to claim 7 wherein the fluid egress in said first chamber is at least 90% by volume of the fluid egress in said second chamber.

9. The dispenser according to claim 7 wherein the fluids in each chamber have substantially same rheology and egress in substantially the same amount of time.

10. The dispenser according to claim 1 wherein said first and second compartment second surfaces each include mating male and female members.

11. The dispenser according to claim 1 wherein said first and second compartment first surfaces have wall thicknesses within the range of from 1 to 30 thousandths of an inch.

12. The dispenser according to claim 1 comprising a common closure for said product openings at a bottom of said dispenser.

13. The dispenser according to claim 12 wherein said common closure includes a separate aperture in communication with each of said product openings and a cap having an open position in which product can exit the dispenser and a closed position in which product is retained within said dispenser.

14. A chamber suitable for a dual dispenser, which chamber comprises:

a) a first wall, b) said first wall having a recessed area, c) a second wall on a side opposite said first wall, d) a top and a bottom at opposite ends of said first and second walls, e) said bottom including a product exit opening, f) a first axis extending from said top to said bottom, at least part of said recess extending in said first wall throughout a plane perpendicular to said axis.

15. The chamber according to claim 14 wherein said second wall includes a projection and a depression, said projection and depression being suitable for mating with a similarly disposed projection and depression on a second chamber.

16. The chamber according to claim 14 wherein at least 60% of the area of said first wall is recessed.

17. The dispenser according to claim 1 wherein said girdle comprises two parts, each having two ends, each of which is interlocked at each end.

18. The dispenser according to claim 1 wherein said first and second pressure plates, respectively, are each attached to said first and second chamber first surfaces.

19. The dispenser according to claim 1 wherein each of said compartments is identical and wherein said compartments are adhered togehter by an adhesive.

20. A first and second compartment according to claim 17 adjacent to each other and snapped into a closure at said compartment bottoms.

* * * * *